US009476257B2

(12) United States Patent
Bilen et al.

(10) Patent No.: US 9,476,257 B2
(45) Date of Patent: Oct. 25, 2016

(54) FORMATION-ENGAGING ASSEMBLIES AND EARTH-BORING TOOLS INCLUDING SUCH ASSEMBLIES

(71) Applicant: Baker Hughes Incorporated, Houston, TX (US)

(72) Inventors: Juan Miguel Bilen, The Woodlands, TX (US); Steven C. Russell, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 123 days.

(21) Appl. No.: 14/272,369

(22) Filed: May 7, 2014

(65) Prior Publication Data

US 2015/0322726 A1 Nov. 12, 2015

(51) Int. Cl.
*E21B 10/42* (2006.01)
*E21B 10/633* (2006.01)
*E21B 10/627* (2006.01)

(52) U.S. Cl.
CPC ..... *E21B 10/42* (2013.01); *E21B 10/627* (2013.01); *E21B 10/633* (2013.01); *E21B 2010/425* (2013.01)

(58) Field of Classification Search
CPC .... E21B 10/633; E21B 10/627; E21B 10/42; E21C 2035/191; E21C 35/193
See application file for complete search history.

(56) References Cited

U.S. PATENT DOCUMENTS 3,148,741 A 9/1964 Holsing
3,760,894 A * 9/1973 Pitifer ..... E21B 10/633 175/413
3,765,496 A * 10/1973 Flores ..... E21B 10/633 175/383
3,805,364 A 4/1974 Gardner
3,999,620 A 12/1976 Watson et al.
4,271,917 A 6/1981 Sahley
4,542,943 A * 9/1985 Montgomery, Jr. .. E02F 9/2866 299/102
4,679,858 A 7/1987 Tank
4,711,144 A 12/1987 Barr et al.
5,096,344 A 3/1992 Fischer et al.
5,906,245 A 5/1999 Tibbitts et al.

(Continued)

FOREIGN PATENT DOCUMENTS

WO 2012149120 A2 11/2012

OTHER PUBLICATIONS

Do et al. U.S. Appl. No. 14/272,360 entitled Formation-Engaging Structures Having Retention Features, Earth-Boring Tools Including Such Structures and Related Methods, filed May 7, 2014.

(Continued)

*Primary Examiner* — Shane Bomar
(74) *Attorney, Agent, or Firm* — TraskBritt

(57) ABSTRACT

A formation-engaging assembly includes a formation-engaging structure holder with a side surface between a proximal end and a distal end, a receptacle in the distal end, and a lateral protrusion extending from a portion of the side surface of the formation-engaging structure holder adjacent the distal end. A formation-engaging structure may include a formation-engaging surface at a distal end, a proximal end and a sidewall therebetween. The proximal end and at least a portion of the sidewall of the formation-engaging structure may be received within the receptacle of the formation-engaging structure holder. Earth-boring tools may include such formation-engaging assemblies.

17 Claims, 5 Drawing Sheets

(56) References Cited

U.S. PATENT DOCUMENTS

| | | | | |
|---|---|---|---|---|
| 6,142,250 | A | 11/2000 | Griffin et al. | |
| 6,427,791 | B1 | 8/2002 | Glowka et al. | |
| 6,920,944 | B2 * | 7/2005 | Eppink | E21B 10/325 175/269 |
| 7,814,997 | B2 | 10/2010 | Aliko et al. | |
| 7,946,656 | B2 * | 5/2011 | Hall | A47C 3/00 299/107 |
| 8,007,050 | B2 * | 8/2011 | Hall | E21B 10/633 299/104 |
| 8,141,665 | B2 | 3/2012 | Ganz | |
| 8,172,008 | B2 | 5/2012 | Dykstra et al. | |
| 2008/0236900 | A1 | 10/2008 | Cooley et al. | |
| 2009/0158898 | A1 | 6/2009 | Sherwood, Jr. et al. | |
| 2011/0114393 | A1 * | 5/2011 | Dolan | E21B 10/633 175/428 |
| 2011/0297454 | A1 * | 12/2011 | Shen | E21B 10/633 175/431 |
| 2012/0054998 | A1 | 3/2012 | Tschida et al. | |
| 2013/0180784 | A1 | 7/2013 | Esko et al. | |
| 2014/0191563 | A1 * | 7/2014 | Elfgen | E21C 35/183 299/104 |
| 2015/0028656 | A1 * | 1/2015 | Sollami | E21C 35/18 299/79.1 |
| 2015/0330153 | A1 | 11/2015 | Miller et al. | |

OTHER PUBLICATIONS

Miller et al., U.S. Appl. No. 14/276,587 entitled Earth-Boring Tools Including Bearing Element Assemblies, and Related Methods, filed May 13, 2014.

Nguyen et al., U.S. Appl. No. 14/933,908 entitled Earth-Boring Tools Carrying Formation-Engaging Structures, filed Nov. 5, 2015.

* cited by examiner

FORMATION-ENGAGING ASSEMBLIES AND EARTH-BORING TOOLS INCLUDING SUCH ASSEMBLIES

CROSS-REFERENCE TO RELATED APPLICATIONS

This application is related to U.S. patent application Ser. No. 14/272,360, filed May 7, 2014, now U.S. Pat. No. 9,359,826, issued Jun. 7, 2016, titled "Formation-Engaging Structures Having Retention Features, Earth-Boring Tools Including Such Structures, and Related Methods," the disclosure of which is hereby incorporated herein in its entirety by this reference. This application is also related to U.S. patent application Ser. No. 14/276,587, filed May 13, 2014, pending, titled "Earth-Boring Tools Including Bearing Element Assemblies, and Related Methods," and to U.S. patent application Ser. No. 14/933,908, filed Nov. 5, 2015, pending, titled "Earth-Boring Tools Carrying Formation-Engaging Structures."

TECHNICAL FIELD

Embodiments of the present disclosure relate to formation-engaging structures for earth-boring tools, earth-boring tools including such structures, and related methods.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutters are fixed in place when used to cut formation materials. A conventional fixed-cutter earth-boring rotary drill bit includes a bit body having generally radially projecting and longitudinally extending blades. During drilling operations, the drill bit is positioned at the bottom of a well borehole and rotated.

A plurality of cutting elements is positioned on each of the blades. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements or cutters. The plurality of PDC cutting elements may be fixed within cutting element pockets formed in rotationally leading surfaces of each of the blades. Conventionally, a bonding material, such as a braze alloy, may be used to secure the cutting elements to the bit body.

Some earth-boring tools may also include bearing elements that may limit the depth-of-cut (DOC) of the cutting elements, protect the cutting elements from excessive contact with the formation, enhance (e.g., improve) lateral stability of the tool, or perform other functions or combinations of functions. The bearing elements conventionally are located entirely rotationally behind associated leading cutting elements to limit DOC as the bearing elements contact and ride on an underlying earth formation, although bearing elements rotationally leading cutting elements are also known.

BRIEF SUMMARY

In one aspect of the disclosure, a formation-engaging assembly includes a formation-engaging structure holder with a side surface between a proximal end and a distal end, a receptacle in the distal end, and a lateral protrusion extending from a portion of the side surface of the formation-engaging structure holder adjacent the distal end. A formation-engaging structure may include a formation-engaging surface at a distal end opposite a proximal end along a sidewall. The proximal end and at least a portion of the sidewall of the formation-engaging structure is received within the receptacle of the formation-engaging structure holder.

In another aspect of the disclosure, an earth-boring tool may include a blade comprising a pocket having a channel extending laterally therefrom to a leading surface of the blade accepting at least a portion of a formation-engaging structure holder. A formation-engaging assembly is disposed within the pocket. The formation-engaging assembly may include a formation-engaging structure holder with a side surface between a proximal end and a distal end, a receptacle in the distal end and a lateral protrusion extending from a portion of the side surface of the formation-engaging structure holder adjacent the distal end. A formation-engaging structure may include a formation-engaging surface at a distal end opposite a proximal end along a sidewall. The proximal end and at least a portion of the sidewall of the formation-engaging structure is received within the receptacle of the formation-engaging structure holder.

BRIEF DESCRIPTION OF THE SEVERAL VIEWS OF THE DRAWINGS

While the specification concludes with claims particularly pointing out and distinctly claiming what are regarded as embodiments of the present invention, various features and advantages of disclosed embodiments may be more readily ascertained from the following description when read with reference to the accompanying drawings, in which:

DETAILED DESCRIPTION

The illustrations presented herein are not actual views of any particular material, cutting element, formation-engaging structure, or earth-boring tool, but are merely idealized representations employed to describe embodiments of the present disclosure. Additionally, elements common between figures may retain the same numerical designation.

Figure 1:
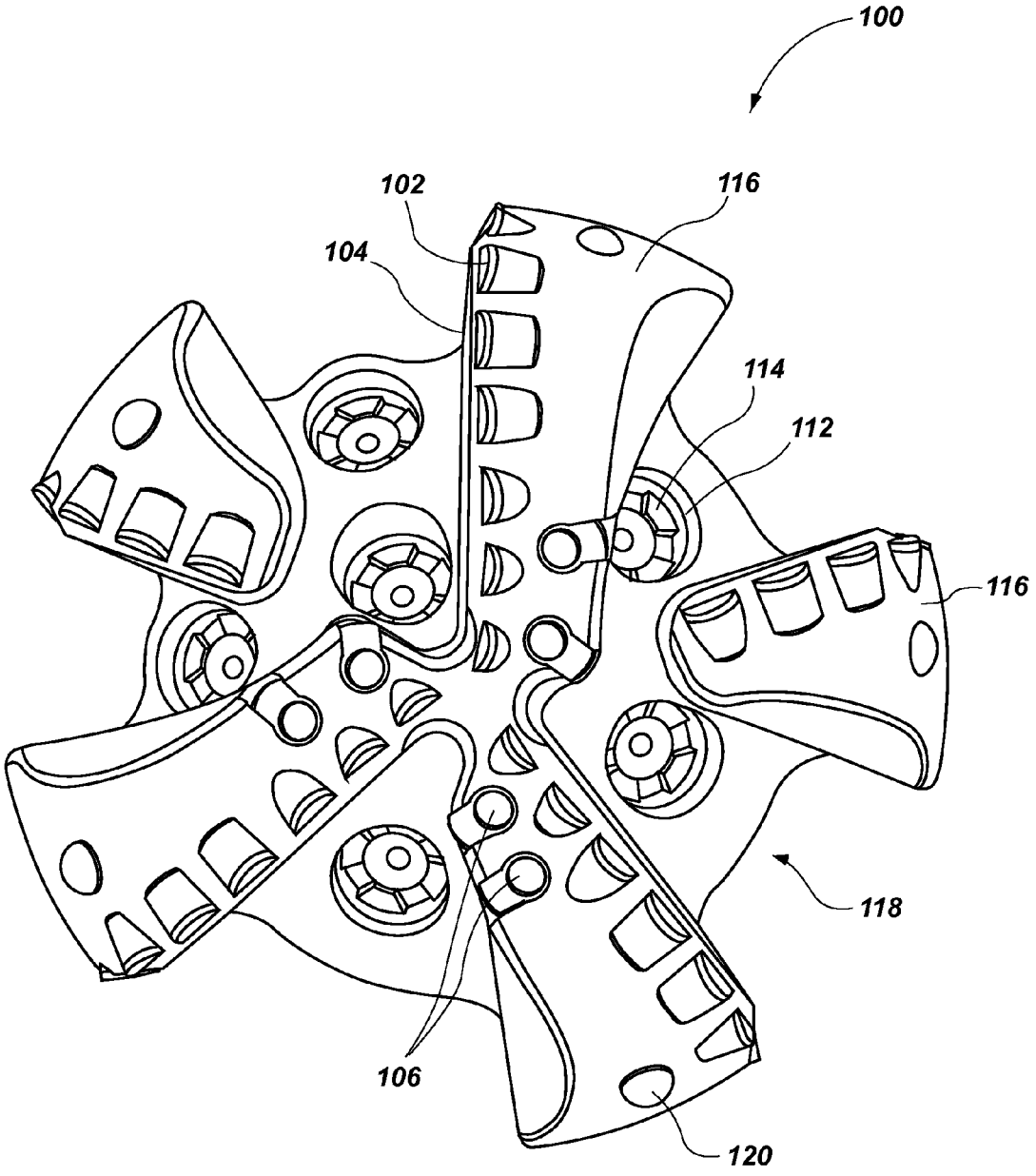
FIG. 1 is a top view of an earth-boring drill bit with formation-engaging assemblies of the disclosure.

FIG. 1 is a top view of an embodiment of an earth-boring tool 100 of the present disclosure. The earth-boring tool 100 of FIG. 1 is configured as an earth-boring rotary drill bit. The earth-boring tool 100, more specifically, comprises a drag bit having a plurality of cutting elements 102 affixed to a body 104 of the earth-boring tool 100. The earth-boring tool 100 also includes one or more formation-engaging assemblies 106 that are attached to the body 104. The formation-engaging assemblies 106 may comprise, for example, cutting elements, bearing elements, or wear knots. The formation-engaging assemblies 106 may include features that interact with features of the earth-boring tool 100 to facilitate retention of the formation-engaging assemblies 106 within the earth-boring tool 100 and removal of the formation-engaging assemblies 106 from the earth-boring tool 100, as discussed in further detail below.

The body 104 of the earth-boring tool 100 may be secured to a shank (not shown) having a threaded connection portion, which may conform to industry standards, such as those promulgated by the American Petroleum Institute (API), for attaching the earth-boring tool 100 to a drill string (not shown).

The body 104 may include internal fluid passageways that extend between fluid ports 112 at the face of the body 104 and a longitudinal bore that extends through the shank and partially through the body 104. Nozzle inserts 114 may be secured within the fluid ports 112 of the internal fluid passageways. The body 104 may further include a plurality of blades 116 that are separated by fluid courses 118, which may be referred to in the art as "junk slots." In some embodiments, the body 104 may include wear knots 120.

Each formation-engaging assembly 106 may be positioned on a blade 116 to rotationally trail at least one cutting element 102, as shown in FIG. 1. In some embodiments, the formation-engaging assembly 106 may be positioned to rotationally follow cutting elements 102 on the same blade 116 at the same radius from the center of earth-boring tool 100, or may be disposed at positions intermediate at least two cutting elements 102 along a radial axis. The formation-engaging structures 106 may be formed partially or fully of a wear-resistant material, such as cemented tungsten carbide, or distal ends thereof may comprise a wear-resistant material, such as cemented tungsten carbide or a superabrasive material such as polycrystalline diamond or cubic boron nitride. The wear-resistant material may comprise a coating or particles of the wear-resistant material over an entirety of the distal end, or inserts of the wear-resistant material embedded in the surface of the distal end.

Figure 2:
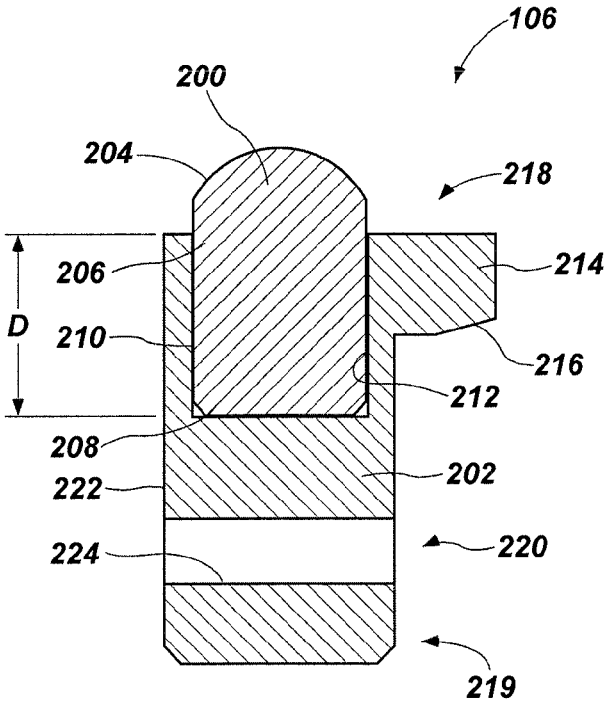
FIG. 2 is a side cross-sectional view of a formation-engaging assembly of an embodiment of the disclosure.

Referring now to FIG. 2, a formation-engaging assembly 106 may include a formation-engaging structure 200 and a formation-engaging structure holder 202. The formation-engaging structure 200 may include a formation-engaging surface 204 at a distal end 206 opposite a proximal end 208 with a side surface 210 of the formation-engaging structure 200 between the distal end 206 and the proximal end 208. The side surface 210 of the formation-engaging structure 200 may also be characterized as a sidewall. The formation-engaging surface 204 may comprise a convex shape, such as a shape generally defined by a portion of a sphere. In some embodiments, the formation-engaging surface 204 may be substantially hemispherical. In some embodiments, the formation-engaging surface 204 may be generally conical or chisel-shaped. In some embodiments, the formation-engaging surface 204 may comprise an asymmetrical shape. Such a formation-engaging structure 200 may be referred to in the art as "ovoid."

In the embodiment of FIG. 2, the side surface 210 of the formation-engaging structure 200 may comprise a circular transverse cross-sectional shape, imparting to the side surface 210 a substantially cylindrical shape. In other embodiments, the cross-sectional shape may include, without limitation, other shapes such as ellipses, polygons, and shapes including both arcuate and rectilinear portions.

The formation-engaging structure holder 202 may include a receptacle 212 for accepting at least a portion of the side surface 210 of the formation-engaging structure 200. The sidewall of receptacle 212 may comprise a cross-sectional shape and of a size similar to the cross-sectional shape of the side surface 210 of the formation-engaging structure 200, such that the formation-engaging structure 200 fits tightly within the receptacle 212. In some embodiments, the sizes of the cross-sectional shapes of the receptacle 212 and the side surface 210 may be chosen to provide a clearance between the side surface 210 and a sidewall of the receptacle 212 to facilitate affixing the formation-engaging structure 200 within the formation-engaging structure holder 202, with, for example, a braze or adhesive.

As a non-limiting example, the formation-engaging structure 200 may be brazed within the receptacle 212. For example, the formation-engaging structure 200 may be at least partially placed within the receptacle 212, and the side surface 210 of the formation-engaging structure 200, the sidewall of the receptacle 212, and a braze material may be heated. The braze material may be drawn into the clearance between the formation-engaging structure 200 and the sidewall of the receptacle 212 by capillary action. In embodiments in which the side surface 210 of the formation-engaging structure 200 is generally cylindrical, the formation-engaging structure 200 may be rotated within the receptacle 212 to facilitate uniform distribution of the braze material within the clearance.

In other embodiments, the formation-engaging structure 200 may be mechanically affixed within the receptacle 212 by, e.g., an interference fit. In yet other embodiments, the formation-engaging structure 200 may be affixed within the receptacle 212 by, e.g., an adhesive.

As non-limiting examples, the formation-engaging structure holder 202 may comprise a metal alloy, such as a steel alloy, or may comprise a cemented tungsten carbide matrix material.

The receptacle 212 may extend from a distal end 218 of the formation-engaging structure holder 202 a depth D into the formation-engaging structure holder 202. Depth D may be chosen based on, e.g., a desired exposure of the formation-engaging structure 200. Multiple formation-engaging structure holders 202 with different depths D of the receptacle 212 may enable a drill bit supplier or drilling operator to provide formation-engaging assemblies 106 with different exposures for formation-engaging structures 200 appropriate for different drilling conditions while using substantially identical formation-engaging structures 200. In some embodiments, the depth D may be effectively adjusted by placing one or more shims in the bottom of receptacle 212 prior to inserting the formation-engaging structure 200 within the receptacle 212.

The formation-engaging structure holder 202 may include features configured to facilitate removal of the formation-engaging assembly 106 from the body 104 of the earth-boring tool 100 (FIG. 1). For example, the formation-engaging structure holder 202 may include a laterally extending protrusion 214 extending from a side surface 222 of the formation-engaging structure holder 202 near a distal end 218 thereof. In the embodiment of FIG. 2, the protrusion 214 may extend around only a portion of a periphery of the formation-engaging structure holder 202, as shown in more detail below in FIG. 4. The protrusion 214 may be configured to interface with a tool adapted to facilitate removal of the formation-engaging assembly 106 from the earth-boring tool 100 (FIG. 1). For example, the protrusion 214 may include a chamfered edge 216 on a surface of the formation-engaging structure holder 202 generally oriented facing away from a distal end 218 of the formation-engaging structure holder 202. In other words, the chamfered edge 216 may be disposed on a proximal surface of the protrusion 214. The chamfered edge 216 may form a gap with a portion of the body 104 (FIG. 1) of the earth-boring tool 100 into which a portion of a tool adapted for pulling or prying may be inserted, as discussed below in connection with FIG. 6.

The formation-engaging structure holder 202 may also include a relief 220 in the side surface 222. In the embodiment of FIG. 2, the relief 220 may comprise a bore 224 extending through the formation-engaging structure holder 202. The relief 220 may be disposed near a proximal end 219 of the formation-engaging structure holder 202.

Figure 3:
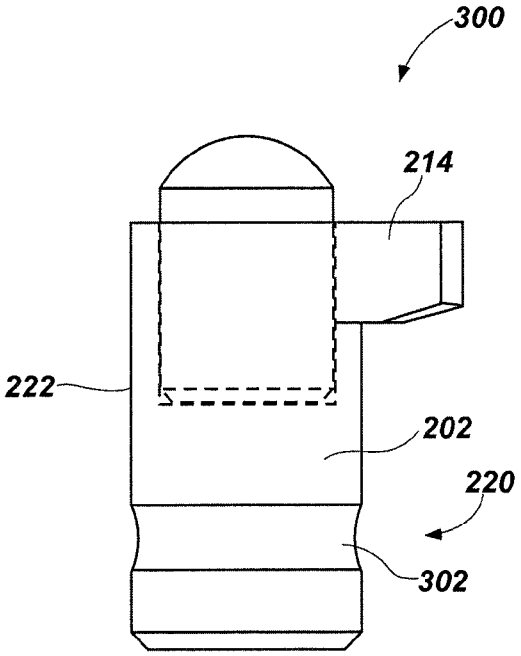
FIG. 3 is a side view of a formation-engaging assembly of an embodiment of the disclosure.

Referring now to FIG. 3, the relief 220 may comprise a groove extending around at least a portion of the side surface 222 of the formation-engaging structure holder 202 of a formation-engaging assembly 300. For example, as shown in FIG. 3, a relief 220 may comprise an annular groove 302 extending around a periphery of the side surface 222 of the formation-engaging structure holder 202. In other embodiments, the relief 220 may comprise one or more grooves or discrete recesses in the side surface 222 similar to the annular groove 302 but extending around only a portion of the periphery of the side surface 222.

Figure 4:
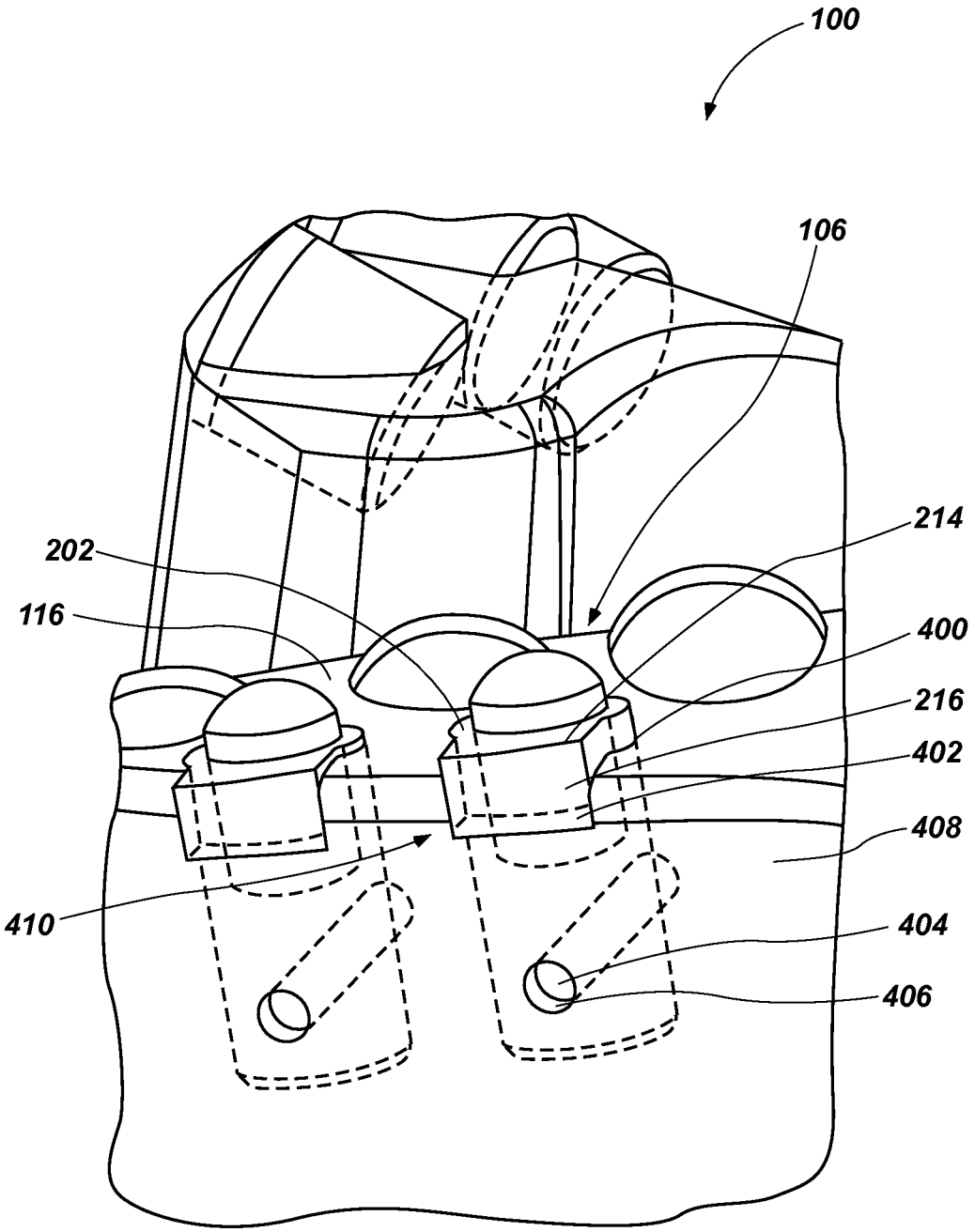
FIG. 4 is an enlarged perspective view of an earth-boring drill bit with a formation-engaging assembly of an embodiment of the disclosure.

Referring now to FIG. 4, at least a portion of a formation-engaging assembly 106 may be disposed within a pocket 400 of a blade 116 of an earth-boring tool 100. The pocket 400 may include a laterally extending portion 402 adjacent a leading surface of blade 116, which portion may also be characterized as a channel, configured to accept at least a portion of a laterally extending protrusion 214 of a formation-engaging structure holder 202.

The blade 116 of the earth-boring tool 100 may include a retainer bore 406 at least partially contiguous with a retainer recess 404. In this embodiment, the retainer recess 404 may extend completely through the blade 116. In other words, the retainer recess 404 may extend from a first surface 408 of the blade 116 to a second, opposite surface (not shown in the perspective of FIG. 4) of the blade 116. The retainer recess 404 may intersect a portion of the pocket 400 of the blade 116. A retaining element 407 (FIG. 5) may be disposed within the retainer bore 406. The retaining element 407 may abut a portion of the formation-engaging structure holder 202 within the relief 220 (FIGS. 2 and 3). For example, with reference to the formation-engaging assembly 106 of FIG. 2, the retaining element 407 may extend through the bore 224 (FIG. 2) of the formation-engaging structure holder 202 to retain the formation-engaging assembly 106 within the pocket 400. Additionally or alternatively, with reference to the formation-engaging assembly 300 of FIG. 3, the retaining element 407 may abut a portion of the formation-engaging structure holder 202 within the annular groove 302 (FIG. 3) to retain the formation-engaging assembly 300 (FIG. 3) within the pocket 400.

In some embodiments, the retaining element 407 may comprise a sheet of resilient (i.e., elastic) material (e.g., a steel alloy) rolled about a longitudinal axis. Elastic expansion of the resilient material of the retaining element 407 may exert a force against the wall of the retainer bore 406 and at least a portion of the surface of the relief 220 of the formation-engaging structure holder 202, thereby enhancing (e.g., increasing) a frictional force between the foil ration-engaging structure holder 202, the retaining element 407, and the retainer bore 406, and securing the retaining element 407 within the retainer bore 406. The resilient material of the retaining element 407 may also elastically deform to enable relative movement between the formation-engaging assembly 106 and the blade 116. For example, elastic movement between the formation-engaging assembly 106 and the blade 116 may at least partially absorb vibration generated by a drilling operation. The resilient material may enable the retaining element 407 to fit tightly within retainer bores 406 having slightly different diameters and/or irregular surface finishes resulting from normal manufacturing inconsistencies.

In other embodiments, the retainer recess 404 may only extend through a portion of the blade 116, and may comprise a threaded bore configured to accept a set screw (not shown). The set screw may be tightened such that a portion of the set screw abuts a portion of a relief 220 of a formation-engaging structure holder 202 to retain a formation-engaging assembly 106, 300 within the pocket 400 of the blade 116.

A chamfered edge 216 of a laterally extending protrusion 214 of the formation-engaging structure holder 202 may provide a gap 410 (FIG. 4) between the blade 116 within a floor of the laterally extending portion 402 of the pocket 400 and the formation-engaging structure holder 202. The shape of the laterally extending protrusion 214 and the chamfered edge 216 may be chosen such that an end of a tool adapted for pulling or prying can be at least partially inserted within the gap 410, as will be discussed further below in connection with FIG. 6.

In some situations, it may be desirable to remove the formation-engaging assembly 106, 300 from the pocket 400. For example, the formation-engaging surface 204 of the formation-engaging assembly 106, 300 may become worn or damaged. Moreover, it may be desirable to replace the formation-engaging assembly 106, 300 with another formation-engaging assembly having different characteristics, e.g., shape or exposure, of the formation-engaging surface 204.

Figure 5:
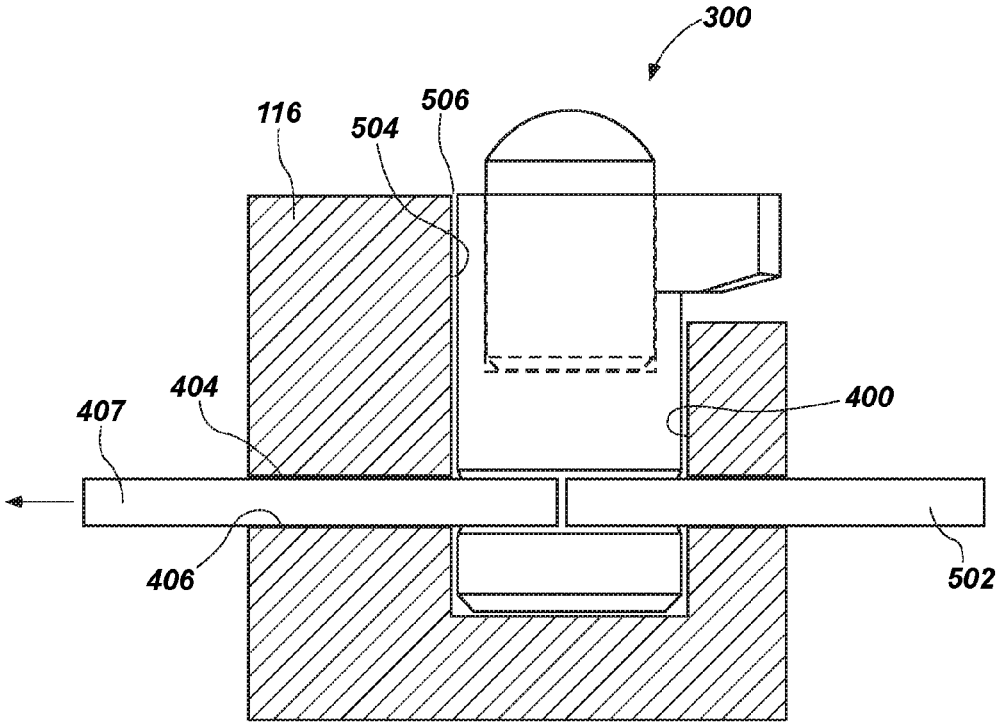
FIG. 5 is a partial cross-sectional side view of a formation-engaging assembly and an earth-boring drill bit of an embodiment of the disclosure.

Accordingly, with reference now to FIG. 5, an operator may use a tool such as a pin punch 502 and a hammer (not shown) to drive the retaining element 407 through the retainer bore 406 and out of the retainer recess 404. The formation-engaging assembly 300 (reference is made to the formation-engaging assembly 300 in FIGS. 5 and 6, but it should be understood that the description is equally applicable to formation-engaging assembly 106 (FIG. 2) or any other embodiment of a formation-engaging assembly according to the disclosure) may then be removed from the pocket 400 of the blade 116.

A clearance 506 may exist between the side surface 222 of the formation-engaging structure holder 202 (FIG. 2) and a sidewall 504 of the pocket 400. The clearance 506 may be provided intentionally, e.g., to facilitate insertion of the formation-engaging assembly 300 within the pocket 400, or may be the product of inaccuracy resulting from normal manufacturing tolerances. In some embodiments, a substantially annular seal, such as an O-ring, may be disposed between the formation-engaging structure holder 202 and the sidewall 504 of the pocket 400. Under some operating conditions, formation cuttings and other drilling debris may pack within the clearance 506. As a result, the formation-engaging assembly 300 may become difficult to remove from the pocket 400.

Figure 6:
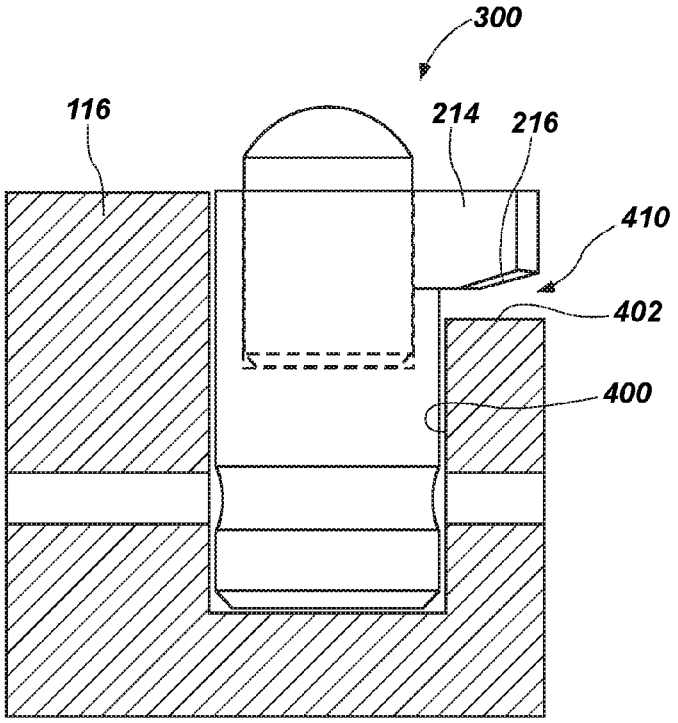
FIG. 6 is a partial cross-sectional side view similar to FIG. 5.

Referring now to FIG. 6, an operator may insert a portion of a tool adapted for pulling or prying, e.g., a jaw of a puller or an end of a screwdriver (not shown), within the gap 410 between the chamfered edge 216 of the laterally extending protrusion 214 and the laterally extending portion 402 of the pocket 400. The operator may pull or pry upwards on the laterally extending protrusion 214 to loosen the formation-engaging assembly 300 from the pocket 400, and may remove the formation-engaging assembly 300 from the blade 116. Another formation-engaging assembly 300, e.g., a formation-engaging assembly 300 with a different depth D of the receptacle 212 of the formation-engaging structure holder 202 and, consequently, a different exposure of the formation-engaging structure 200 (FIG. 2), may then be inserted in the pocket 400, and the retaining element 407 may be replaced within the retainer bore 406.

Figure 7:
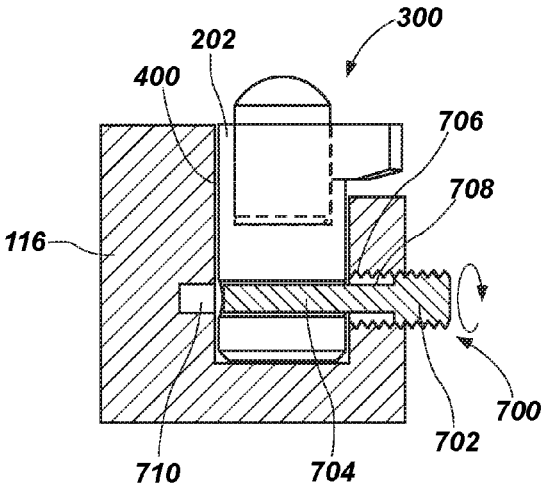
FIG. 7 is a partial cross-sectional side view of a formation-engaging assembly and a retaining element of an embodiment of the disclosure.

Referring now to FIG. 7, a formation-engaging assembly 300 may be retained within a pocket 400 of a blade 116 by a retaining element 700. The retaining element 700 may include a threaded head 702 and a shank 704. A retainer bore 706 may include a threaded segment 708 and a segment 710 with a reduced diameter relative to the threaded segment 708. At least a portion of the reduced diameter segment 710 may intersect the pocket 400. The threaded head 702 may include features configured to interface with a tool adapted to apply torque. For example, the threaded head 702 may include a receptacle (not shown) in an axial end thereof configured to accept a tool, such as a hex wrench, a square drive bit, a star drive bit, or other tools.

Figure 8:
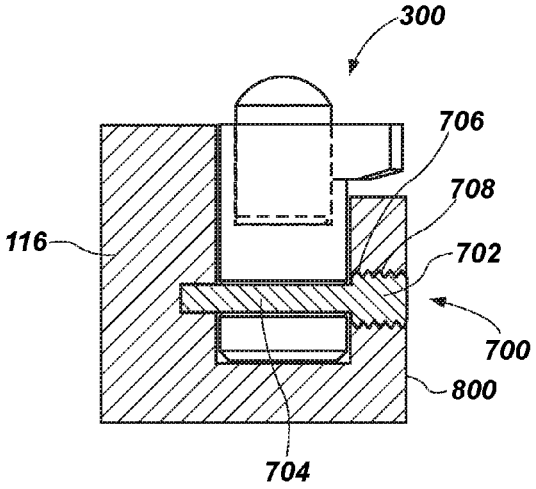
FIG. 8 is a partial cross-sectional side view similar to FIG. 7.

To install the retaining element 700 within the retainer bore 706, an operator may insert the shank 704 into the retainer bore 706 until the threads on the threaded head 702 begin to engage the threads of the threaded segment 708. The operator may insert a tool into the receptacle of the threaded head 702 to rotate retaining element 700, apply torque and thread the threaded head 702 completely into the threaded segment 708 of the retainer bore 706, as shown in FIG. 8. In the position shown in FIG. 8, the threaded head 702 is substantially flush with a surface 800 of the blade 116. In other embodiments, the threaded head 702 may sit above or below the surface 800 of the blade 116 when the threaded head 702 is fully threaded into the threaded segment 708 of the retainer bore 706.

At least a portion of the shank 704 of the retaining element 700 may abut a portion of the formation-engaging structure assembly 300 within a bore 224 (FIG. 2) or an annular groove 302 (FIG. 3) of a formation-engaging structure holder 202 to retain the formation-engaging structure assembly 300 within the pocket 400 of the blade 116.

Figure 9:
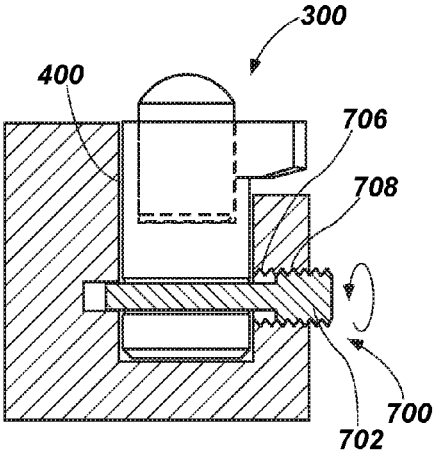
FIG. 9 is a partial cross-sectional side view similar to FIG. 8.

To remove the retaining element 700 from the retainer bore 706, the operator may insert a tool into the receptacle of the threaded head 702 as described above and rotate retaining element 700 to apply torque in the opposite direction to loosen the threaded head 702 of the retaining element 700 from the threaded segment 708 of the retainer bore 706, as shown in FIG. 9. The operator may completely remove the retaining element 700 from the retainer bore 706, and may remove the formation-engaging assembly 300 from the pocket 400 substantially as described above in connection with FIG. 6.

Figure 10:
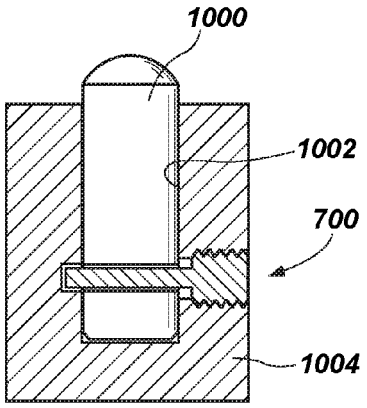
FIG. 10 is a partial cross-sectional side view of a formation-engaging structure and a retaining element of an embodiment of the disclosure.

The retaining element 700 shown in FIGS. 7 through 9 may be used with a formation-engaging assembly 300 as described above. Furthermore, the retaining element 700 may be used with formation-engaging structures that do not include a formation-engaging structure holder 202, as shown in FIG. 2. For example, in the embodiment of FIG. 10, a formation-engaging structure 1000 may be disposed directly within a pocket 1002 of a blade 1004 of an earth-boring tool 100 (FIG. 1) (i.e., the formation-engaging structure 1000 may not include a formation-engaging structure holder). As a further non-limiting example, the retaining element 700 as described herein may be used with formation-engaging structures as disclosed in U.S. Patent Publication No. 2015/0322727, filed May 7, 2014, and assigned to the same assignee, which is incorporated herein by reference for all that it discloses.

Additional non-limiting example embodiments of the disclosure are set forth below.

Embodiment 1

A formation-engaging assembly, comprising: a formation-engaging structure holder, comprising: a side surface between a proximal end and a distal end; a receptacle in the distal end; and a lateral protrusion extending from a portion of the side surface of the formation-engaging structure holder adjacent the distal end; and a formation-engaging structure with a formation-engaging surface at a distal end, a proximal end and a sidewall therebetween, wherein the proximal end and at least a portion of the sidewall of the formation-engaging structure is received within the receptacle of the formation-engaging structure holder.

Embodiment 2

The formation-engaging assembly of Embodiment 1, wherein the lateral protrusion extends from only a portion of a periphery of the side surface of the formation-engaging structure holder.

Embodiment 3

The formation-engaging assembly of Embodiment 1 or Embodiment 2, wherein the lateral protrusion comprises a chamfered edge.

Embodiment 4

The formation-engaging assembly of Embodiment 3, wherein the chamfered edge is disposed on a proximal portion of the lateral protrusion.

Embodiment 5

The formation-engaging assembly of any one of Embodiments 1 through 4, wherein the formation-engaging structure holder further comprises a relief in the side surface.

Embodiment 6

The formation-engaging assembly of Embodiment 5, wherein the relief comprises an annular groove extending around at least a portion of a periphery of the side surface.

Embodiment 7

The formation-engaging assembly of Embodiment 5 or Embodiment 6, wherein the relief comprises a bore extending through the formation-engaging structure holder.

Embodiment 8

The formation-engaging assembly of any one of Embodiments 1 through 7, wherein the formation-engaging structure is brazed within the receptacle of the formation-engaging structure holder.

Embodiment 9

An earth-boring tool, comprising: a blade comprising a pocket in a leading end thereof for accepting at least a portion of a formation-engaging structure holder, the pocket having a portion of reduced depth extending therefrom to a side surface of the blade; and a formation-engaging assembly disposed within the pocket, the formation-engaging assembly comprising: a formation-engaging structure holder, comprising: a side surface between a proximal end and a distal end; a receptacle in the distal end; and a lateral protrusion extending from a portion of the side surface of the formation-engaging structure holder adjacent the distal end received in the pocket portion of reduced depth; and a formation-engaging structure with a formation-engaging surface at a distal end, a proximal end and a sidewall therebetween, wherein the proximal end and at least a portion of the sidewall of the formation-engaging structure is received within the receptacle of the formation-engaging structure holder.

Embodiment 10

The earth-boring tool of Embodiment 9, wherein the blade of the earth-boring tool comprises a retainer bore extending into the blade from a surface thereof and at least partially intersecting the pocket, and a retaining element disposed within the retainer bore and extending at least partially within a relief in a side surface of the formation-engaging structure holder.

Embodiment 11

The earth-boring tool of Embodiment 10, wherein a portion of the retaining element abuts a portion of the formation-engaging structure holder within a relief in the side surface of the formation-engaging structure holder or extends through a bore in the side surface of the formation-engaging structure holder.

Embodiment 12

The earth-boring tool of Embodiment 10 or Embodiment 11, wherein the retainer bore extends completely through the blade of the earth-boring tool.

Embodiment 13

The earth-boring tool of Embodiment 11, wherein the retaining element comprises an elongated pin.

Embodiment 14

The earth-boring tool of any one of Embodiments 10 through 13, wherein the retainer bore comprises a threaded portion adjacent the surface of the blade of the earth-boring tool.

Embodiment 15

The earth-boring tool of Embodiment 14, wherein the retaining element comprises a set screw engaged with the threaded portion of the retainer bore.

Embodiment 16

The earth-boring tool of any one of Embodiments 9 through 15, wherein the earth-boring tool is a fixed-cutter rotary drill bit.

Embodiment 17

The earth-boring tool of any one of Embodiments 14 through 16, wherein the retaining element comprises a threaded head and a shank of lesser diameter, the threaded head engaged with the threaded portion of the retainer bore.

Embodiment 18

The earth-boring tool of any one of Embodiments 11 through 13, wherein the retaining element comprises a sheet of resilient material rolled about a longitudinal axis thereof.

Although the foregoing description contains many specifics, these are not to be construed as limiting the scope of the present invention, but merely as providing certain exemplary embodiments. Similarly, other embodiments of the invention may be devised, which do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. A formation-engaging assembly, comprising:

a formation-engaging structure holder, comprising:

a substantially cylindrical side surface between a proximal end and a distal end;

a receptacle extending longitudinally into the distal end;

a relief in the substantially cylindrical side surface, wherein the relief comprises a bore extending through the formation-engaging structure holder; and a lateral protrusion extending from a portion of the substantially cylindrical side surface of the formation-engaging structure holder only adjacent the distal end; and a formation-engaging structure with a formation-engaging surface at a distal end, a proximal end and a sidewall therebetween, wherein the proximal end and at least a portion of the sidewall of the formation-engaging structure is received within the receptacle of the formation-engaging structure holder.

2. The formation-engaging assembly of claim 1, wherein the lateral protrusion extends from only a portion of a periphery of the substantially cylindrical side surface of the formation-engaging structure holder.

3. The formation-engaging assembly of claim 1, wherein the lateral protrusion comprises a chamfered edge.

4. The formation-engaging assembly of claim 3, wherein the chamfered edge is disposed on a proximal portion of the lateral protrusion.

5. The formation-engaging assembly of claim 1, wherein the formation-engaging structure is brazed within the receptacle of the formation-engaging structure holder.

6. An earth-boring tool, comprising:

a blade comprising a substantially cylindrical pocket in a leading end thereof for accepting at least a portion of a formation-engaging structure holder, the substantially cylindrical pocket having a portion of reduced depth extending laterally therefrom to a surface of the blade transverse to the leading end of the blade; and a formation-engaging assembly disposed within the substantially cylindrical pocket, the formation-engaging assembly comprising:

a formation-engaging structure holder, comprising:

a substantially cylindrical side surface between a proximal end and a distal end;

a receptacle extending longitudinally into the distal end; and a lateral protrusion extending from a portion of the substantially cylindrical side surface of the formation-engaging structure holder adjacent the distal end received in the substantially cylindrical pocket portion of reduced depth; and a formation-engaging structure with a formation-engaging surface at a distal end, a proximal end and a sidewall therebetween, wherein the proximal end and at least a portion of the sidewall of the formation-engaging structure is received within the receptacle of the formation-engaging structure holder.

7. The earth-boring tool of claim 6, wherein the blade of the earth-boring tool comprises a retainer bore extending into the blade from a surface thereof and at least partially intersecting the substantially cylindrical pocket, and a retaining element disposed within the retainer bore and extending at least partially within a relief in the substantially cylindrical side surface of the formation-engaging structure holder.

8. The earth-boring tool of claim 7, wherein a portion of the retaining element at least one of abuts a portion of the formation-engaging structure holder within the relief in the substantially cylindrical side surface of the formation-engaging structure holder or extends through a bore in the substantially cylindrical side surface of the formation-engaging structure holder.

9. The earth-boring tool of claim 7, wherein the retainer bore extends completely through the blade of the earth-boring tool.

10. The earth-boring tool of claim 7, wherein the retaining element comprises an elongated pin.

11. The earth-boring tool of claim 7, wherein the retainer bore comprises a threaded portion adjacent the surface of the blade of the earth-boring tool.

12. The earth-boring tool of claim 11, wherein the retaining element comprises a set screw engaged with the threaded portion of the retainer bore.

13. The earth-boring tool of claim 6, wherein the earth-boring tool is a fixed-cutter rotary drill bit.

14. The earth-boring tool of claim 11, wherein the retaining element comprises a threaded head and a shank of lesser diameter, the threaded head engaged with the threaded portion of the retainer bore.

15. The earth-boring tool of claim 7, wherein the retaining element comprises a sheet of resilient material rolled about a longitudinal axis thereof.

16. The earth-boring tool of claim 6, further comprising cutting structures located on the blade, wherein the substantially cylindrical pocket in the leading end of the blade comprises the substantially cylindrical pocket located at least one of rotationally leading or trailing the cutting structures.

17. The earth-boring tool of claim 6, wherein the formation-engaging surface of the formation-engaging structure comprises a wear-resistant material comprising at least one of tungsten carbide, polycrystalline diamond or cubic boron nitride.

* * * * *